US007644499B2

(12) United States Patent
Smoot et al.

(10) Patent No.: US 7,644,499 B2
(45) Date of Patent: Jan. 12, 2010

(54) PROTECTIVE SLEEVE COVER FOR PRINTING ROLL

(75) Inventors: Michael A. Smoot, Chesterfield, VA (US); Mark C. Davis, Chester, VA (US)

(73) Assignee: XYMID, LLC, Midlothian, VA (US)

( * ) Notice: Subject to any disclaimer, the term of this patent is extended or adjusted under 35 U.S.C. 154(b) by 615 days.

(21) Appl. No.: 11/411,634

(22) Filed: Apr. 26, 2006

(65) Prior Publication Data

US 2007/0251847 A1 Nov. 1, 2007

(51) Int. Cl.
*B21D 53/00* (2006.01)
*B65D 85/00* (2006.01)

(52) U.S. Cl. ..... 29/895.23; 29/450; 29/446; 492/48; 206/289; 206/446; 53/410; 53/411

(58) Field of Classification Search ..... 29/895.23, 29/895.2, 446, 450; 492/48, 39; 206/389, 206/407, 414, 446; 53/410, 411, 441
See application file for complete search history.

(56) References Cited

U.S. PATENT DOCUMENTS 352,911 A * 11/1886 Dungan ..... 492/39
1,833,461 A * 11/1931 Grupe ..... 492/28
3,449,811 A * 6/1969 De Ligt ..... 29/895.21
3,630,586 A * 12/1971 Pitner ..... 296/116
3,677,856 A * 7/1972 McCallum et al. ..... 156/187
4,484,785 A * 11/1984 Jackson ..... 175/325.6
5,387,172 A * 2/1995 Habenicht et al. ..... 492/50
5,396,990 A * 3/1995 Bell et al. ..... 206/391
5,615,845 A * 4/1997 Kewin ..... 242/613.5
5,725,178 A * 3/1998 Kewin ..... 242/613.5
5,829,713 A * 11/1998 Kewin ..... 242/613.5
6,183,452 B1 * 2/2001 Bodmer et al. ..... 604/308
6,193,186 B1 * 2/2001 Kewin ..... 242/613.5
6,797,331 B2 * 9/2004 Singler et al. ..... 427/450
6,997,411 B2 * 2/2006 Kewin ..... 242/613.5
7,171,139 B2 * 1/2007 Nagy et al. ..... 399/109

* cited by examiner

*Primary Examiner*—Essama Omgba
(74) *Attorney, Agent, or Firm*—Connolly Bove Lodge & Hutz

(57) ABSTRACT

A protective sleeve cover is described for protecting anilox, gravure, or other costly rolls. The protective sleeve cover is cylindrical in geometry and has a means at one end for securing the cover to the roll being protected. The protective sleeve cover is readily mounted or demounted from the roll. Expansion tabs on the inner diameter of the protective sleeve cover create an interference fit with the roll being protected, causing the protective sleeve cover to deform and generate radial forces that enhance the gripping action of the protective sleeve cover to the roll. Friction pads can be added for enhanced gripping function with the roll.

22 Claims, 3 Drawing Sheets

PROTECTIVE SLEEVE COVER FOR PRINTING ROLL

BACKGROUND OF THE INVENTION

Within the printing industry a variety of rolls are used for different purposes. In describing this invention, the term "roll" or "rolls" is used exclusively. However, the invention is equally applicable to sleeves, the distinction being that rolls typically have journals or shafts while sleeves are typically hollow in the middle. Some of these rolls are more costly than others such as anilox rolls for transferring ink to printing plates or gravure rolls in which the print image is engraved onto the metal surface. It is desirable to protect these rolls from damage when shipping them to locations, placing them into or out of the press or simply keeping them in storage. Various methods have been used to protect these rolls including vinyl blankets and plastic sleeves. The blankets often have a Velcro strap for holding the cover in place. The plastic sleeves are often slit down the length allowing the cover to be opened and wrapped around the roll. These types of covers work well for presses where the rolls are readily exposed and accessible to the operator. In recent years, however, a new type of press has become very popular wherein the rolls are mounted from the side of the press rather than the front. As a result, the operator no longer has access to the full roll length when it is in the press. Instead, they must slide the roll sideways, thus removing it from its mounting cylinder. With this configuration, it is very difficult to secure a cover to the roll.

Attempts have been made to develop new covers that can be mounted from the side of the press. One such approach is to use a thin sleeve with a rubber ring attached to the end of the sleeve that grips the roll upon contact. However, the sleeve must be sized very precisely in order to readily mount the sleeve due to the inability of the sleeve to deform in the cylindrical configuration.

SUMMARY OF THE INVENTION

An objective of this invention is to provide a suitable means for protecting rolls which is both easy to apply and simple to secure to the roll being protected.

In accordance with this invention a protective sleeve cover (PSC) is comprised of a cylindrical sleeve with elements at one end of the PSC which cause the PSC to deform during mounting and then grip the outer surface of the roll being protected. Expansion tabs either affixed or molded to the inner diameter and very close to the end of the PSC provide an interference fit with the roll being protected. When the PSC is completely mounted to the roll, the expansion tabs move radially outward and deform the PSC, causing the chord region between the expansion tabs to move radially inward. The PSC can be designed so that the chord region may contact the roll as well when fully engaged. Friction pads can be added to further increase the gripping action of the chord region.

THE DRAWINGS

FIG. 1 gives the general shape of a roll that would need a PSC for protection, in accordance with this invention;

DETAILED DESCRIPTION

The present invention relates to improvements in a Protective Sleeve Cover (PSC) for protecting rolls such as anilox or gravure rolls from damage that might occur in transit, loading or unloading from a press or during storage.

In general, the PSC of this invention consists of a thin cylindrical shell whose inner diameter is larger than the outer diameter of the roll it is intended to protect. Expansion tabs exist at one end of the PSC and are located around the inner circumference. The purpose of the expansion tabs is to contact the roll being protected and to deform the PSC end so as to produce a radial force upon the roll, thus causing the PSC to grip the roll and secure the PSC in position.

Figure 1:
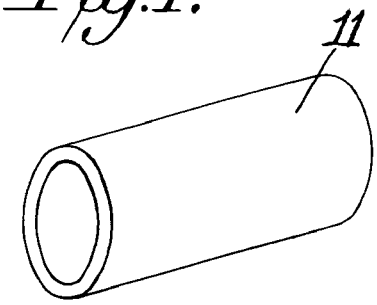

FIG. 1 shows a typical roll 11 that would require protection. For this example the roll 11 is cylindrical in nature and hollow in the middle. However, PSC's can be used to protect rolls with shafts or journals.

Figure 2:
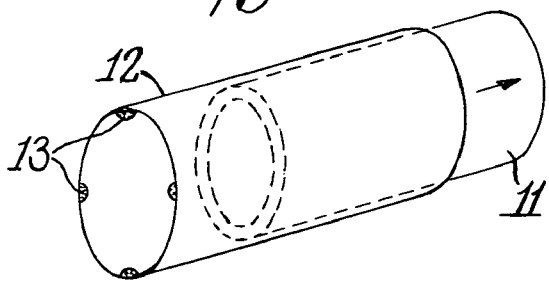
FIG. 2 depicts a PSC being mounted onto a roll in accordance with this invention.

FIG. 2 shows the PSC 12 being mounted to the roll 11. During most of the mounting procedure, the PSC 12 readily slides onto the roll 11 because the PSC's 12 inner diameter is larger than the outer diameter of the roll 11 being protected. Expansion tabs 13 are located at one end and around the inner circumference of the PSC 12. Expandable tabs 13 can be attached to the PSC 12 using a variety of method including mechanically fastened, adhesively bonded or even molded into the PSC itself. In this example, four expansion tabs 13 are shown. The invention could be practiced using any suitable number of expansion tabs and preferably at least two expansion tabs. In the preferred practice of the invention the expansion tabs are spaced equally around the inner surface at the trailing end of the PSC 12. Larger diameter PSCs 12 will have more expansion tabs 13 to distribute the loads on the roll 11 and provide the appropriate deflection of the PSC 12. As the expansion tabs 13 on the PSC 12 begin to engage the roll 11, resistance begins to build due to an interference fit between the expansion tabs 13 and the roll 11.

In one preferred practice of the invention all of the expansion tabs are co-arcuately arranged. The invention, however, could be practiced where there is some offset or longitudinal stagger regarding the spacing of the expansion tabs 13 which would cause one or more of the expansion tabs 13 to contact the outer surface of the roll 11 before the remaining expansion tabs 13. An advantage of having the expansion tabs longitudinally staggered is that there is a gradual lifting and distortion of the PSC 12 as it is longitudinally telescoped over the roll 11. Such staggering could be by having each expansion tab 13 longitudinally offset with respect to each other or by having two or more expansion tabs 13 coarcuate but longitudinally offset from at least one other expansion tab 13.

Figure 3A:
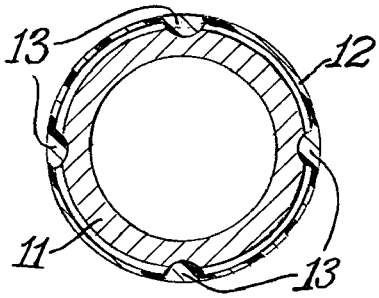
FIG. 3A is an end view of a PSC whose expansion tabs have not yet made contact with the roll in accordance with this invention.
Figure 3B:
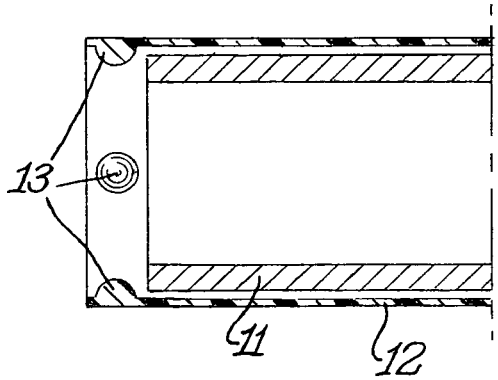
FIG. 3B is a side view cross section of a PSC whose expansion tabs have not yet made contact with the roll in accordance with this invention.

FIG. 3A depicts an end view of a PSC 12 whose expansion tabs 13 have not yet made contact with the roll 11. FIG. 3B is a side view cross section of a PSC 12 whose expansion tabs 13 have not yet made contact with the roll 11. From these two figures it is evident that the radial distance between the expansion tabs 13 is smaller than the outer diameter of the roll 11. Consequently, interference exists between the expansion tabs 13 and the roll 11 when they make intimate contact.

Figure 4A:
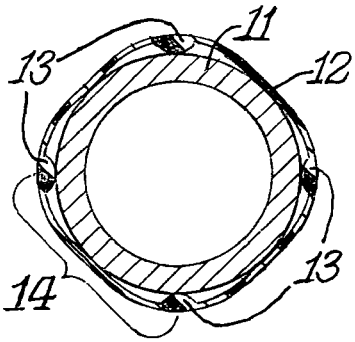
FIG. 4A is an end view of a PSC whose expansion tabs have made contact with the roll thus deforming the shape of the PSC in accordance with this invention.
Figure 4B:
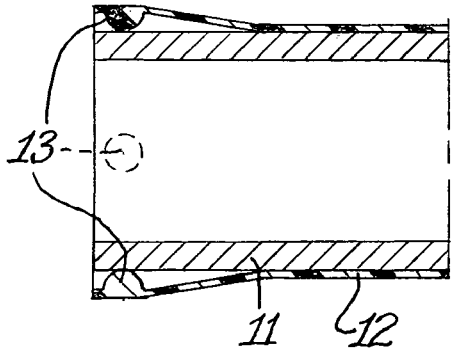
FIG. 4B is a side view cross section of a PSC whose expansion tabs have made contact with the roll thus deforming the shape of the PSC in accordance with this invention.

FIG. 4A shows an end view of a PSC 12 whose expansion tabs 13 have made contact with the roll 11 thus deforming the shape of the PSC 12. Because the expansion tabs 13 are thinner at the leading edge, the radially force is initially moderate but begins to increase as the PSC 12 advances onto the roll 11. The deformation of the PSC 12 results in the material between the expansion tabs 13, herein defined as the chord 14, drawing closer to the roll 11. Conversely, the deformation of the PSC 12 also results in the material above the expansion tabs 13 moving away from the roll 11. The combination of these two radial deformations produces increased stress in the PSC which creates a radial load onto the roll 11 which holds the PSC 12 in place. The expansion tabs 13 can be located in a such a manner that the chords 14 begin to press against the roll 11 thus providing additional gripping force against the roll 11. However, it is not required that the chords 14 come into contact with the roll 11. FIG. 4B is a side view cross section of a PSC 12 whose expansion tabs 13 have made contact with the roll 11 thus deforming the shape of the PSC 12. From this figure it is evident that the PSC 12 only deforms down a portion of its length. The further the distance from the end, the more the PSC 12 exhibits its circular, non-deformed cross-section.

Because the PSCs are protecting rolls that are inherently expensive and susceptible to damage, it is desirable that the cover be designed to have a relatively low flexural stiffness. The flexural stiffness is determined through a combination of the thickness of the PSC wall, the diameter of the PSC and the flexural modulus of the material used to fabricate the PSC. Smaller diameter PSCs will have a thinner wall while larger diameter PSCs will have thicker walls. Typical PSC walls will be no thicker than 0.200 inches and preferably in the range from 0.030 inches to 0.100 inches thick. In some instances it may be advantageous to add an inner layer of foam or rubber to provide additional impact resistance. In those cases the total PSC thickness can be up to 0.400 inches thick and preferably up to 0.350 inches thick. Diameters typically range from 3 inches to 18 inches for PSCs. Flexural modulus of the material used to fabricate PSCs ranges from 300,000 to 3,000,000 psi.

Figure 5A:
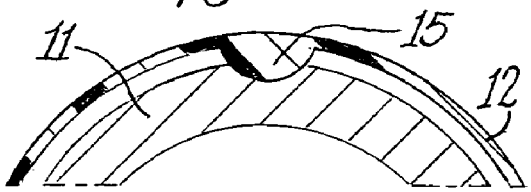
FIG. 5A is an end view of a compressible expansion tab that has not yet made contact with the roll in accordance with this invention.
Figure 5B:
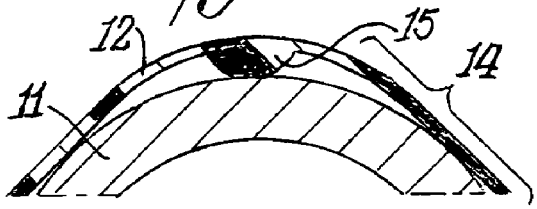
FIG. 5B is an end view of a compressible expansion tab that has made contact with the roll thus compressing the expansion tab and deforming the shape of the PSC in accordance with this invention.

For smaller rolls it may not be necessary to have as much radial force to hold the PSC in place. In those instances, another embodiment of the current invention can be employed. In this case, the expansion tabs can be made from a material that is compressible such as foam or rubber. FIG. 5A depicts an end view of a compressible expansion tab 15 that has not yet made contact with the roll 11. FIG. 5B is an end view of a compressible expansion tab 15 that has made contact with the roll 11 thus compressing the compressible expansion tab 15 and deforming the shape of the PSC 12 but not as much as when non-compressible expansion tabs are used. Consequently, the chord 14 does not move as far and may not contact the roll 11.

Figure 6A:
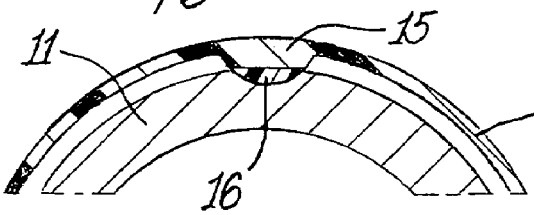
FIG. 6A is an end view of a compressible expansion tab with a wear surface button that has not yet made contact with the roll in accordance with this invention.
Figure 6B:
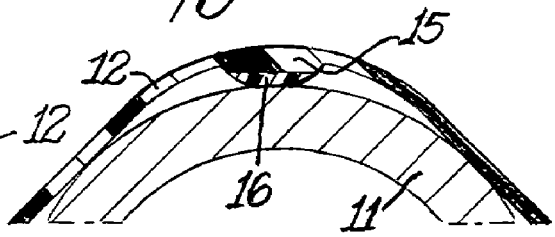
FIG. 6B is an end view of a compressible expansion tab with a wear surface layer that has made contact with the roll thus compressing the expansion tab and deforming the shape of the PSC in accordance with this invention.

Another embodiment of the current invention is to have a compressible expansion tab with a non-compressible element or "wear surface layer" on the surface that will contact the roll. FIG. 6A depicts this arrangement as it shows an end view of a compressible expansion tab 15 with a wear surface layer 16 that has not yet made contact with the roll 11. FIG. 6B shows an end view of a compressible expansion tab 15 with a wear surface layer 16 that has made contact with the roll 11 thus compressing the compressible expansion tab 15 and deforming the shape of the PSC 12 though not as much as when non-compressible expansion tabs are used.

Figure 7A:
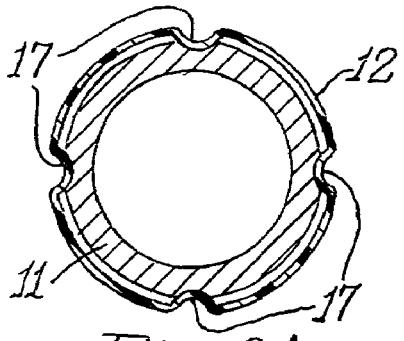
FIG. 7A is an end view of a PSC with molded expansion tabs that have not yet made contact with the roll in accordance with this invention.
Figure 7B:
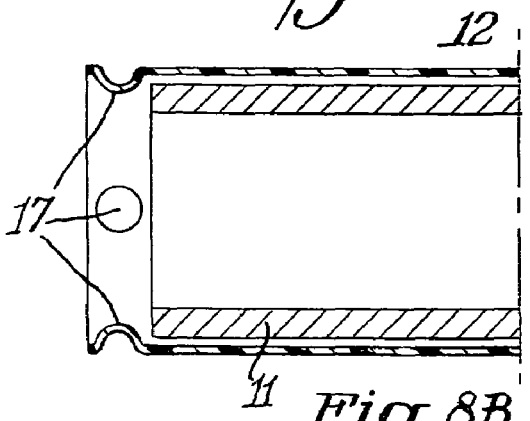
FIG. 7B is a side view cross section of a PSC with molded expansion tabs that have not yet made contact with the roll in accordance with this invention.
Figure 8A:
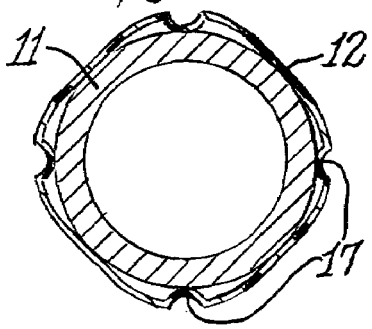
FIG. 8A is an end view of a PSC with molded expansion tabs that have made contact with the roll thus deforming the shape of the PSC in accordance with this invention.
Figure 8B:
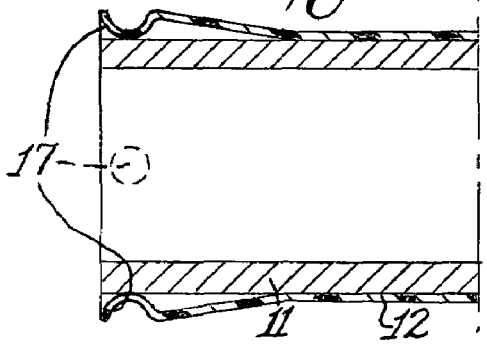
FIG. 8B is a side view cross section of a PSC with molded expansion tabs that have made contact with the roll thus deforming the shape of the PSC in accordance with this invention.

Another embodiment of the current invention is to mold the expansion tabs directly into the PSC. FIG. 7A shows an end view of a PSC 12 with molded expansion tabs 17 that have not yet made contact with the roll 11. FIG. 7B is a side view cross section of a PSC 12 with molded expansion tabs 17 that have not yet made contact with the roll 11. As with the previous configurations, the molded expansion tabs 17 have an interference fit with the roll 11. Once the PSC 12 is fully mounted onto the roll, the molded expansion tabs 17 contact the roll 11, thus deforming the PSC 12. FIG. 8A depicts an end view of a PSC 12 with molded expansion tabs 17 that have made contact with the roll 11 thus deforming the shape of the PSC 12. FIG. 8B is a side view cross section of a PSC 12 with molded expansion tabs 17 that have made contact with the roll 11 thus deforming the shape of the PSC 12. In this case as well, the chords 14 may or may not come into contact with the roll 11. However, even moderate deformation provides added gripping force to the molded expansion tabs 17.

Figure 9A:
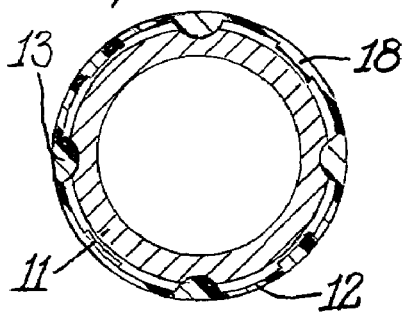
FIG. 9A is an end view of a PSC with expansion tabs and friction pads that have not yet made contact with the roll in accordance with this invention.
Figure 9B:
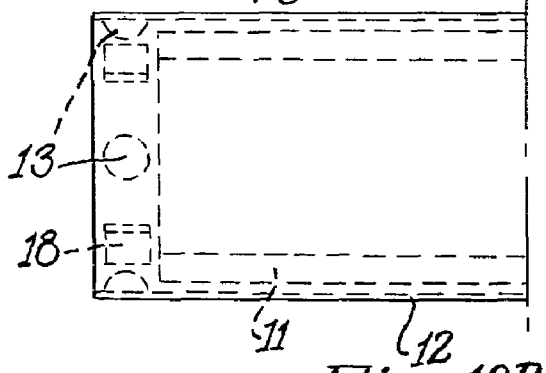
FIG. 9B is a side view of a PSC with expansion tabs and friction pads that have not yet made contact with the roll in accordance with this invention.
Figure 10A:
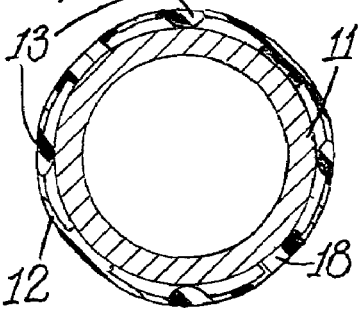
FIG. 10A is an end view of a PSC with expansion tabs and friction pads that have made contact with the roll thus deforming the shape of the PSC and drawing the friction pads into contact with the roll in accordance with this invention.
Figure 10B:
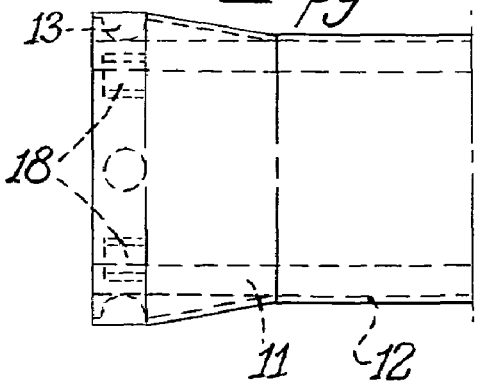
FIG. 10B is a side view cross section of a PSC with expansion tabs and friction pads that have made contact with the roll thus deforming the shape of the PSC and drawing the friction pads into contact with the roll in accordance with this invention.

Another embodiment of the current invention is to add friction tabs to the chord region between the expansion tabs. FIG. 9A is an end view of a PSC 12 with expansion tabs 13 and friction pads 18 that have not yet made contact with the roll 11. FIG. 9B is a side view of a PSC 12 with expansion tabs 13 and friction pads 18 that have not yet made contact with the roll 11. Friction pads 18 can provide further gripping action that the chords 14 alone cannot provide due to lower coefficients of friction associated with the materials used. Friction pads 18 can be made of various materials including foam or rubber. They can be compressible or non-compressible materials. FIG. 10A depicts an end view of a PSC 12 with expansion tabs 13 and friction pads 18 that have made contact with the roll 11 thus deforming the shape of the PSC 12 and drawing the friction pads 18 into contact with the roll 11. FIG. 10B is a side view cross section of a PSC 12 with expansion tabs 13 and friction pads 18 that have made contact with the roll 11.

As previously discussed the expansion tabs 13 could be secured to the PSC 12 in any suitable manner such as illustrated and described. Other manners of securement could include forming the expansion tab 13 from a structural member which extends completely through the PSC 12 (similar to a rivet) from its outer surface to the inner surface so as to extend radially beyond the inner surface. Another manner of forming expansion tab 13 is to fold a member around the outer edge of the PSC 12 so that part of the folded member is disposed at the outer surface of the PSC 12 and the remaining part of the folded member is at the inner surface of the PSC 12 where it functions as the expansion tab 13.

Figure 11:
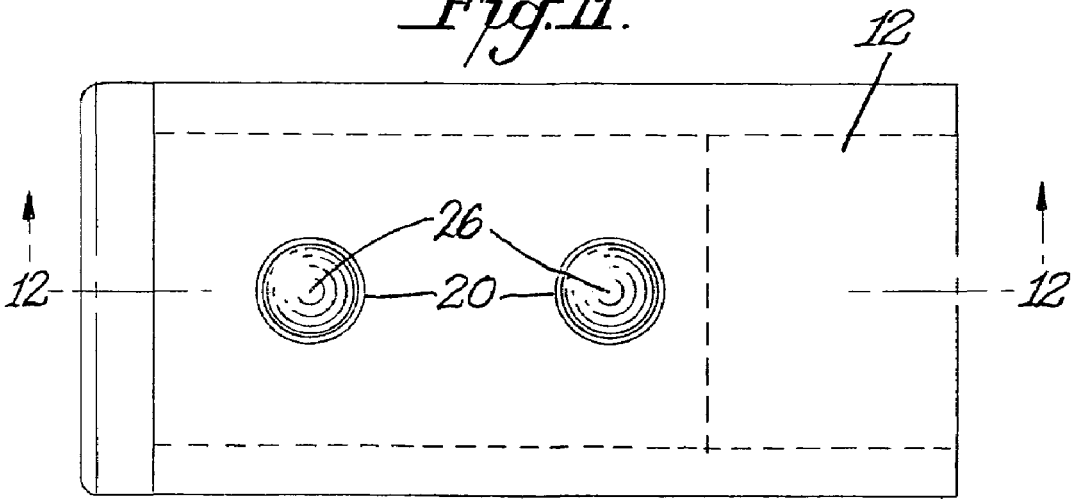
FIG. 11 is a top plan view of a PSC showing a modified expansion tab.
Figure 12:
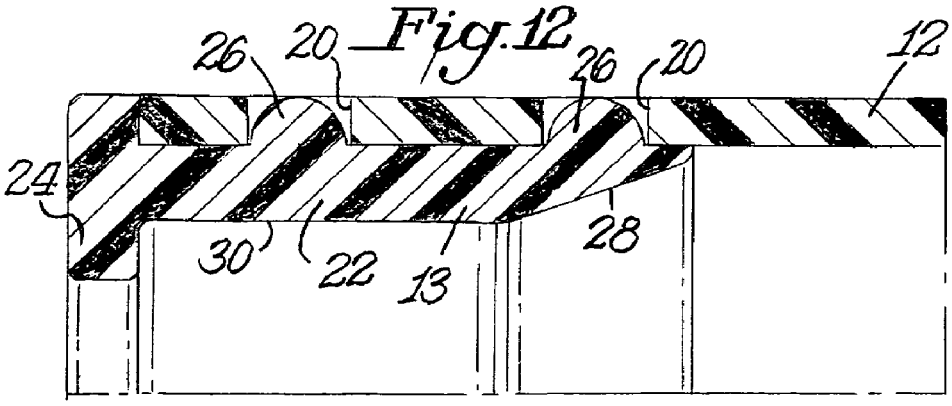
FIG. 12 is a cross-sectional view taken through FIG. 11 along the line 12-12.

FIGS. 11-12 show another variation of this invention. As illustrated therein the expansion tab 13 is a separate member mechanically locked to the PSC 12. In order to achieve this mechanical locking one and preferably two or more holes 20 are formed completely through PSC 12. Expansion tab 13 may be considered as being of elbow shape having a longitudinal section 22 and a radial extension 24. The longitudinal section 22 includes a number of outward projections 26 corresponding in size and location to the holes 20 in PSC 12. Radial extension 24 includes a portion which extends radially inwardly of section 22 (to function as a stop member, as later described) and could also optionally include a radial portion extending outwardly of section 22.

To mount expansion tab 13 to PSC 12, expansion tab 13 would be positioned at the outer edge of PSC 12 and would be inserted into PCS 12 until securing tabs 26 enter the holes 20. This firmly locates and anchors expansion tab 13 in the proper position. When the mounted tab 13 is in place, the outer edge of PSC 12 abuts the optional outward portion of radial extension 24 so that the outward radial portion thereby has a locating function. Longitudinal section 22 could be sufficiently deflectable and/or securing tabs 26 could be sufficiently compressible to permit longitudinal section 22 to slide into PSC 12 and then have securing tabs 26 enter holes 20.

Other manners of locating and anchoring expansion tab 13 to PSC 12 could also be used. For example, longitudinal section 22 could include a longitudinal slot whereby expansion tab 13 would be of generally "F" shape with the PSC 12 located in the slot between the longitudinal portions of the F-shaped expansion tab. The securing tabs could be on either the inward surface of the outer longitudinal portion and/or on the outward surface of the inner longitudinal portion of the F-shaped tab 13. The radial portion connecting the two longitudinal portions could further function to engage the outer edge of the PSC 12 and cooperate as locating structure. Securing tabs 26 may take various forms such as being integral with expansion tab 13 (as illustrated) or being a separate member connected to expansion tab 13 before or after expansion tab 13 is mounted in place.

As shown in FIG. 12 expansion tab 13 has a lead camming surface 28 which could be slanted or curved and then which merges into a flat contact surface 30. In operation the camming surface 28 would facilitate the PSC 12 being telescoped over the roll 11 until the roll 11 is against the contact surface 30 which would then result in distorting the PSC 12 as previously described.

A particularly advantageous feature of the expansion tab 13 shown in FIGS. 11-12 is the incorporation of the inward radial extension 24 which acts as a stop member to limit the degree to which the PSC can be telescoped over roll 11 since the telescoping action would end when roll 11 contacts stop extension 24.

The provision of a stop member, such as radial extension 24, could be incorporated in other forms of expansion tabs. Thus, for example, in embodiments of the expansion tab which extend completely to the outer edge of the PSC 12, a radial extension could be provided having a stop surface in line with the outer edge of the PSC 12 so that the stop surface would limit the degree of telescoping of the PSC 12 over roll 11.

As is apparent from the foregoing description the PSC 12 is used for protecting a roll 11, particularly as used in printing. The PSC 12 is in the form of a thin hollow member having an inner surface with the expansion tabs 13 located at the inner surface at the trailing end and extending radially inwardly. The lead end would be of a diameter slightly larger than the diameter of the roll 11 so that when the PSC is mounted on the roll the lead end is readily telescoped over the roll and the PSC is thereby mounted around the roll in this manner until the expansion tabs 13 begin to contact the outer surface of the roll 11. Each expansion tab 13 has a camming surface which could be slanted or curved and which merges into a contact surface. Thus, each expansion tab 13 smoothly increases in thickness from the camming surface to the contact surface. The contact surface extends radially inwardly a greater distance than the camming surface. The contact surface is also located closer to the outer edge of the trailing end of the PSC than is the camming surface. The contact surface could be located precisely at the outer edge of the trailing end, but preferably is spaced slightly inwardly. The expansion tabs 13 are preferably located within the last, for example, 10% of the length of the PSC. When the PSC is mounted in place it is substantially circular or cylindrical over most of its length from the lead end toward the trailing end with about 75% of the length of the PSC being circular so that the distorted non-circular shape at the trailing end is confined over only a short length of the PSC.

Preferably the entire PSC 12 is made of the same material or combination of materials having the same properties, namely the ability to stretch or be deformed. The invention, however, could be broadly practiced where the lead end of the PSC 12 does not expand and/or is not as stretchable as the trailing end. What is important is that the PSC 12 should sufficiently cover the roll 11 to the extent of being able to protect the roll 11. The ability for the PSC 12 to stretch or distort is a requirement at the trailing end but not necessarily at the lead end.

What is claimed:

1. A protective sleeve cover for protecting a roll, comprising a thin hollow member having an inner surface and having a lead end and a trailing end, said trailing end being radially stretchable, said trailing end having an inner diameter, a plurality of expansion tabs intermittently spaced on said inner surface at said trailing end and extending radially inwardly from said inner surface, said inner surface of said member being smooth and of uniform diameter from said lead end to said trailing end inwardly of said tabs, said lead end having an inner diameter which is larger than the diameter of said trailing end at said expansion tabs whereby said lead end may be readily telescoped over the roll and whereby the contacting of said expansion tabs with the outer surface of the roll causes said trailing end to be distorted to a non-circular shape to create an interference fit with the roll while said cover remains cylindrical at said lead end.

2. The protective sleeve cover of claim 1 wherein at least two of said expansion tabs are longitudinally offset from each other.

3. The protective sleeve cover of claim 1 wherein said expansion tabs are adhesively bonded to said inner surface.

4. The protective sleeve cover of claim 1 wherein said expansion tabs are integrally molded into said inner surface.

5. The protective sleeve cover of claim 1 wherein said expansion tabs are made from a non-compressible material.

6. The protective sleeve cover of claim 1 wherein said expansion tabs are made from a compressible material.

7. The protective sleeve cover of claim 1 wherein friction pads are located on said inner surface between pairs of expansion tabs to provide additional gripping force between said cover and the roll.

8. The protective sleeve cover of claim 1 wherein said friction pads extend inwardly a lesser distance than said expansion tabs whereby said friction pads do not make contact with the roll being protected until said protective sleeve cover deforms due to the interference fit between said expansion tabs and the roll.

9. The protective sleeve cover of claim 1 wherein said hollow member is between 0.030 inches and 0.200 inches thick.

10. The protective sleeve cover of claim 1 wherein said hollow member has an inner layer of foam or rubber, and said hollow member having a thickness no greater than 0.500 inches.

11. The protective sleeve cover of claim 1 wherein the flexural modulus in the circumferential direction of the material used for said cover is between 300,000 psi and 3,000,000 psi.

12. The protective sleeve cover of claim 1 wherein said expansion tabs are mechanically fastened to said inner surface.

13. The protective sleeve cover of claim 12 wherein said expansion tab includes a radially inwardly extending stop member for limiting the extent to which said cover may be telescoped over the roll.

14. The protective sleeve cover of claim 1 wherein a radially inwardly extending stop member is located at the outer edge of said hollow member to limit the extent to which said cover may be telescoped over the roll.

15. The protective sleeve cover of claim 1 in combination with the roll being protected, said roll being of cylindrical shape, said cover being mounted over the outer surface of said roll, an interference fit being created between said trailing end of said cover and said roll, and thus distorting said trailing end to a non-circular shape, and said inner surface of said member having a constant diameter relationship to said outer surface of said roll throughout its length from said lead end of said member to an area at said trailing end where said trailing end is distorted by said tabs.

16. The protective sleeve cover of claim 15 wherein said lead end of said cover is of circular shape and is of larger inside diameter than the outside diameter of said roll.

17. The protective sleeve cover of claim 16 wherein said roll is an anilox/gravure roll.

18. The protective sleeve cover of claim 17 in further combination, wherein said roll is part of a printing press.

19. A protective sleeve cover for protecting a roll used in printing, comprising a thin hollow member having an inner surface and having a lead end and a trailing end, said trailing end being radially stretchable, said trailing end having an inner diameter, a plurality of expansion tabs intermittently spaced on said inner surface at said trailing end and extending radially inwardly from said inner surface, said lead end having an inner diameter which is larger than the diameter of said trailing end at said expansion tabs whereby said lead end may be readily telescoped over the roll and whereby the contacting of said expansion tabs with the outer surface of the roll causes said trailing end to be distorted to a non-circular shape to create an interference fit with the roll while said cover remains cylindrical at said lead end, each of said expansion tabs has a camming surface and a contact surface, each of said expansion tabs smoothly increasing in thickness from said camming surface to said contact surface, and said contact surface being closer to the outer edge of said trailing end than to said camming surface.

20. The protective sleeve of claim 19 wherein said expansion tabs are co-arcuate with each other, and said camming surface being curved or slanted.

21. A protective sleeve cover for protecting a roll used in printing, comprising a thin hollow member having an inner surface and having a lead end and a trailing end, said trailing end being radially stretchable, said trailing end having an inner diameter, a plurality of expansion tabs intermittently spaced on said inner surface at said trailing end and extending radially inwardly from said inner surface, said lead end having an inner diameter which is larger than the diameter of said trailing end at said expansion tabs whereby said lead end may be readily telescoped over the roll and whereby the contacting of said expansion tabs with the outer surface of the roll causes said trailing end to be distorted to a non-circular shape to create an interference fit with the roll while said cover remains cylindrical at said lead end, and said expansion tabs have a layer of compressible material and a layer of non-compressible material to contact the roll being protected.

22. A method of protecting a cylindrical roll in a printing press comprising providing a cover in the form of a hollow sleeve having a lead end and a trailing end and with the sleeve being of cylindrical shape and with the lead end having a larger inside diameter than the outer diameter of the roll, telescoping the sleeve over the roll starting at the lead end, the sleeve maintaining its cylindrical shape until expansion tabs on the inside surface of the sleeve at the trailing end contact the outer surface of the roll, creating an interference fit between the trailing end of the sleeve and the roll at the expansion tabs, and distorting the shape of the sleeve at the trailing end to a non-circular shape to produce a radial force upon the roll thereby causing the sleeve to grip the roll and secure the sleeve in position.

* * * * *